US005686517A

United States Patent [19]

Wells

[11] Patent Number: 5,686,517

[45] Date of Patent: Nov. 11, 1997

[54] POLYAMIDE FIBER

[75] Inventor: Rodney Lee Wells, Chester, Va.

[73] Assignee: AlliedSignal Inc., Morristown, N.J.

[21] Appl. No.: 575,449

[22] Filed: Dec. 20, 1995

Related U.S. Application Data

[63] Continuation of Ser. No. 243,036, May 16, 1994, abandoned.

[51] Int. Cl.[6] ..... C08L 77/00

[52] U.S. Cl. ..... 524/447; 524/431

[58] Field of Search ..... 524/447, 431

[56] References Cited

U.S. PATENT DOCUMENTS

| | | | |
|---|---|---|---|
| 3,063,784 | 11/1962 | Etchison | 8/115.5 |
| 3,366,597 | 1/1968 | Fort | 260/40 |
| 3,378,514 | 4/1968 | Norton | 260/37 |
| 3,397,171 | 8/1968 | Iler | 260/37 |
| 3,988,287 | 10/1976 | Inokuchi et al. | 260/37 |
| 4,749,736 | 6/1988 | Khanna et al. | 524/230 |
| 4,985,486 | 1/1991 | Westeppe | 524/514 |
| 5,109,051 | 4/1992 | Kroenke et al. | 524/444 |
| 5,244,958 | 9/1993 | Goodman | 524/447 |

FOREIGN PATENT DOCUMENTS 3-81364 4/1991 Japan .

OTHER PUBLICATIONS

Chemical Abstracts, Abstract No. 49097c, Kato et al., "Thermplastic Synthetic Fibers", vol. 80, No. 10, Mar. 11, 1974.

Partial European Search Report for EP 95 10 5882, dated Apr. 8, 1995.

*Primary Examiner*—Ana Woodward

*Attorney, Agent, or Firm*—Melanie L. Brown; Virginia S. Andrews

[57] ABSTRACT

A polyamide fiber that includes 0.3 to 2.0 weight percent kaolin clay having an average particle size of 0.1 to 2.0 microns, and less than 0.1 weight percent titanium dioxide, said weight percents being based on the weight of the fiber, and a method for making the same. The polyamide fiber is particularly useful as a carpet fiber.

5 Claims, 2 Drawing Sheets

POLYAMIDE FIBER

This application is a continuation of application Ser. No. 08/243,036 filed May 16, 1994, now abandoned.

FIELD OF THE INVENTION

This invention relates to a polyamide fiber useful as carpet face fiber that has reduced luster and an improved, wool-like, appearance.

BACKGROUND OF THE INVENTION

Titanium dioxide has long been used as a material for delustering synthetic polymers, especially filament-forming polymers such as polyamides which are used as textile components. A disadvantage of its use in polymers such as polyamides, however, is the photoactivation of oxygen at its surface by ultraviolet ("UV") wavelengths of light which are transmitted by the polymer. Highly reactive free radicals are formed which may attack the polymer chains, causing embrittlement and strength loss. The titanium dioxide surface can then reabsorb oxygen and atmospheric moisture and again be photoactivated; hence, the titanium dioxide functions as a photocatalyst for degradation of polymers and the dyes contained in polymers. Another problem with titanium dioxide is that it imparts an undesirable chalky appearance to polyamide fiber at a loading above 0.10 weight percent. A need exists, therefore, for a polyamide fiber that includes zero or a reduced amount of titanium dioxide and exhibits low luster.

Japanese Published Patent Application No. 3-81364 describes a polyamide resin composition that includes montmorillonite ($Al_2O_3.4SiO_2.H_2O$) and U.S. Pat. No. 3,063,784 describes a method of treating nylon with a montmorillonite solution. U.S. Pat. No. 3,366,597 describes a method for incorporating calcined kaolinite into a polyester fiber. The patent indicates that a polyester fiber may include a broad, general range of 0.1 to 10 and a preferred range of 0.1 to 3.0 weight percent calcined kaolinite having an average particle diameter of 0.5 to 1.5 microns. The calcined kaolinite is used in addition to titanium dioxide and all the exemplified fibers include at least 0.1 weight percent titanium dioxide. U.S. Pat. No. 3,988,287 describes a polyamide composition that includes 5 to 70 weight percent clay and a treating agent for the clay.

SUMMARY OF THE INVENTION

It is an object of the invention to provide a polyamide fiber having an improved, wool-like appearance and a method for making the same. Such a fiber can be very useful as a face fiber in carpets. In accomplishing this object there is provided according to the invention a polyamide fiber comprising 0.3 to 2.0 weight percent kaolin day having an average particle size of 0.1 to 2.0 microns, and less than 0.1 weight percent titanium dioxide, and a carpet that includes such a polyamide fiber as a face fiber. There also is provided a method for imparting decreased chalkiness to a polyamide fiber that includes at least 0.1 weight percent titanium dioxide, comprising incorporating 0.3 to 2.0 weight percent kaolin clay having an average particle size of 0.1 to 2.0 microns into said polyamide fiber.

Further objects, features and advantages of the invention will become apparent from the detailed description of preferred embodiments that follows.

BRIEF DESCRIPTION OF THE DRAWING

The invention will be described below in more detail with reference to the drawing, wherein.

DETAILED DESCRIPTION OF THE PREFERRED EMBODIMENTS

Figure 1:
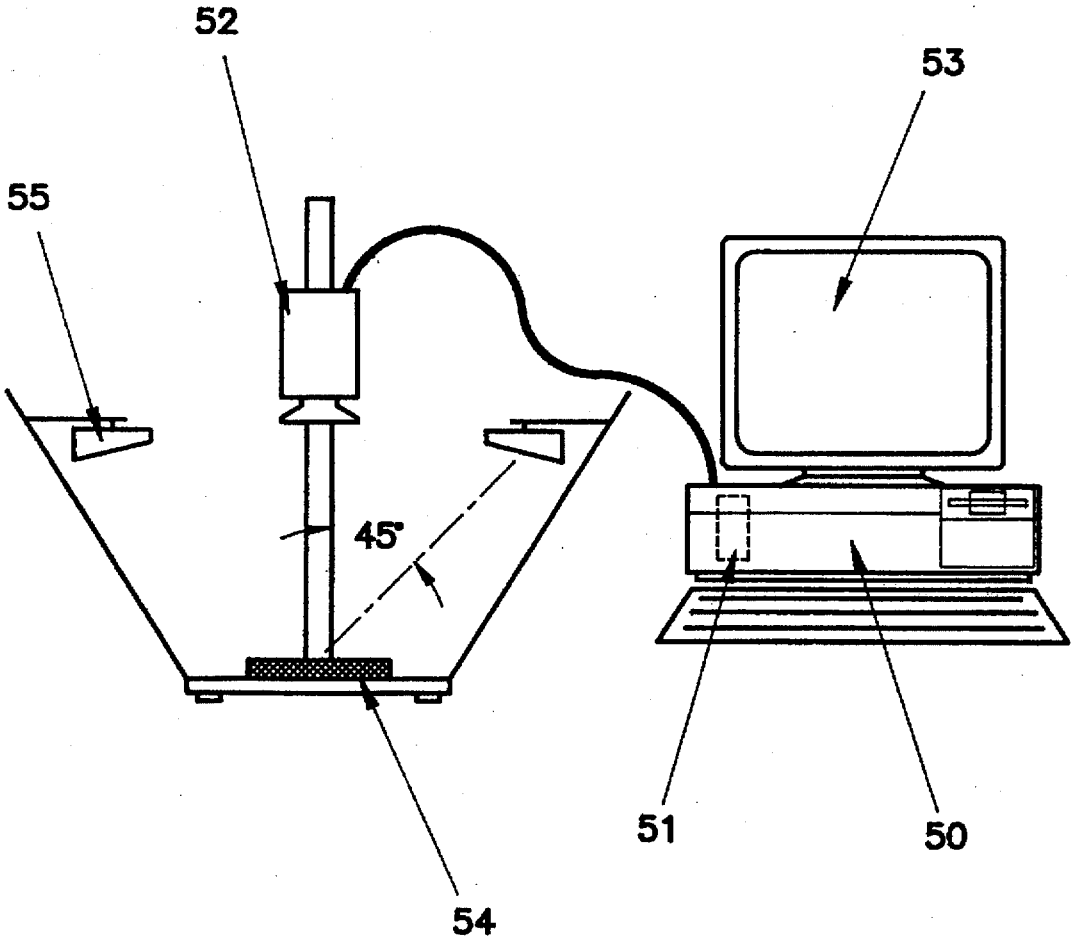
FIG. 1 is a schematic representation of a system used to measure relative luster of carpet samples.

As used herein, "polyamide" denotes nylon 6, nylon 66, nylon 6/66, nylon 4, nylon 6/12, nylon 6/66/12 and other polymers containing the $$\left(\underset{\underset{O}{\|}}{C}-N\right)$$

structure along with the $(CH_2)_x$ chain. Nylon 6 and 66 are preferred.

As used herein, "fiber" denotes an elongate body, the length dimension of which is much greater than the transverse dimensions of width and thickness. Accordingly, "fiber" includes, for example, monofilament, multifilament yarn (continuous or staple), ribbon, strip, staple and other forms of chopped, cut or discontinuous fiber, and the like having regular or irregular cross-sections. "Fiber" includes a plurality of any one of the above or a combination of the above.

The kaolin clay used in this invention may be either hydrous ($Al_2O_3.2SIO_2.2H_2O$) or calcined ($Al_2O_3.2SIO_2$). Hydrous and calcined kaolin clay are well known, commercially available materials. Calcined kaolin clay is preferred because it is more white than hydrous kaolin clay, thus, having less impact on the color of the polyamide fiber. Preferably, the kaolin clay is not surface treated.

The average particle size of the kaolin clay should be 0.1 to 2.0, preferably 0.1 to 1.0, and most preferably 0.1 to 0.5, microns. If an average particle diameter above 2.0 microns is used, there will be an increased tendency for clogging of the screen pack through which the polyamide passes immediately prior to entering the spinneret.

The kaolin clay may be incorporated into the polyamide fiber by a variety of techniques. For example, the kaolin day can be mixed with the monomer(s) that forms the polyamide prior to polymerization or it can be mixed with a nonvolatile oil to form a pourable slurry which is then added to the polyamide. The preferred method is by a masterbatch technique wherein a concentrate that contains polyamide and the kaolin clay is blended or letdown into a feed or base polyamide resin. The blend is then spun into fiber. The preferred blending method is melt injecting the concentrate into a spinning machine that includes the base polyamide resin. The concentrate should include about 9 to about 50, preferably about 25 to about 35, weight percent kaolin clay, based on the weight of the concentrate, with the remainder being polyamide. Since the kaolin clay is blended with the polyamide resin prior to fiber formation, the kaolin clay particles are present in the body of the fiber rather than only at the surface of the fiber.

The amount of kaolin clay in the polyamide fiber should be from about 0.3 to about 2.0, preferably from about 0.6 to about 1.0, weight percent, based on the weight of the polyamide fiber. If less than 0.3 weight percent is included, the polyamide fiber will not exhibit the desired low luster. Above 2.0 weight percent, the increase in luster reduction is negligible compared to the increase in processing difficulties and fiber property shortcomings. Between 0.6 and 1.0 weight percent, decreased chalkiness is maximized.

A significant advantage of the kaolin clay is that it replaces all or a portion of the conventionally used titanium dioxide. Prior to this invention, polyamide fibers typically required at least about 0.1 weight percent of titanium dioxide in order to obtain the desired luster level. As discussed previously, phototactivation of titanium dioxide causes fading of dyed polyamide fibers and titanium dioxide imparts an undesirable chalkiness to the fiber. Combination of the kaolin clay with lower amounts of titanium dioxide results in a luster level that is achieved with the higher conventional level of titanium dioxide alone. Kaolin clay, in affect, acts as an extender for the more expensive titanium dioxide. Consequently, the amount of titanium dioxide necessary in the polyamide fiber ranges from effectively 0 weight percent to less than 0.1 weight percent. As used herein, "effectively 0 weight percent" means that the polyamide fiber can include up to a trace amount of titanium dioxide provided such trace amount does not materially effect any properties of the polyamide fiber.

The polyamide fiber of the invention can be processed by known methods into a carpet yarn which may be made of multiple continuous filaments or spun staple fiber, both typically textured for increased bulk. The carpet yarn may be used as the face fiber in any type of carpet such as tufted or woven carpets. The polyamide fiber can also be used in apparel, flags, belts or other industrial uses.

The polyamide fiber of the invention, particularly when it is used in carpets, exhibits very low luster and chalkiness. In addition, when the polyamide fiber is dyed and tufted into carpet face fiber the resulting clarity of color closely resembles the desirable appearance of wool. Dyed polyamide fibers that contain calcined kaolin day additive exhibited no adverse effect when tested for xenon, ozone and nitrogen oxide lightfastness.

The following examples are presented to demonstrate the advantages of the invention. The specific techniques, conditions, materials, proportions and reported data set forth to illustrate the principles of the invention are exemplary and should not be construed as limiting the scope of the invention.

The luster values depicted in Tables 1 and 3 below were measured by the method described in commonly assigned allowed U.S. patent application Ser. No. 80,640 (filed Jun. 24, 1993), incorporated herein by reference. In particular, the luster or sparkle was measured using a carpet image analyzer system. This system is illustrated in FIG. 1 and consists of a desktop computer 50, an image grabber board 51 capable of digitizing an image into 256 (horizontal)×200 (vertical) pixels that each have 32 possible levels of red, green and blue, a video camera 52 with zoom and close-up lenses and an analog video monitor 53. A carpet yarn sample 54 was placed on a stand and two fluorescent tubes 55 were arranged in a parallel and symmetrical pattern at an angle of about 45° relative to the sample plane. The carpet yarn samples 54 were prepared by winding yarn on black cardboard to cover an area of about 3×3 inches. The carpet yarn samples 54 were arranged with the filament axis parallel to the light direction.

Figure 2:
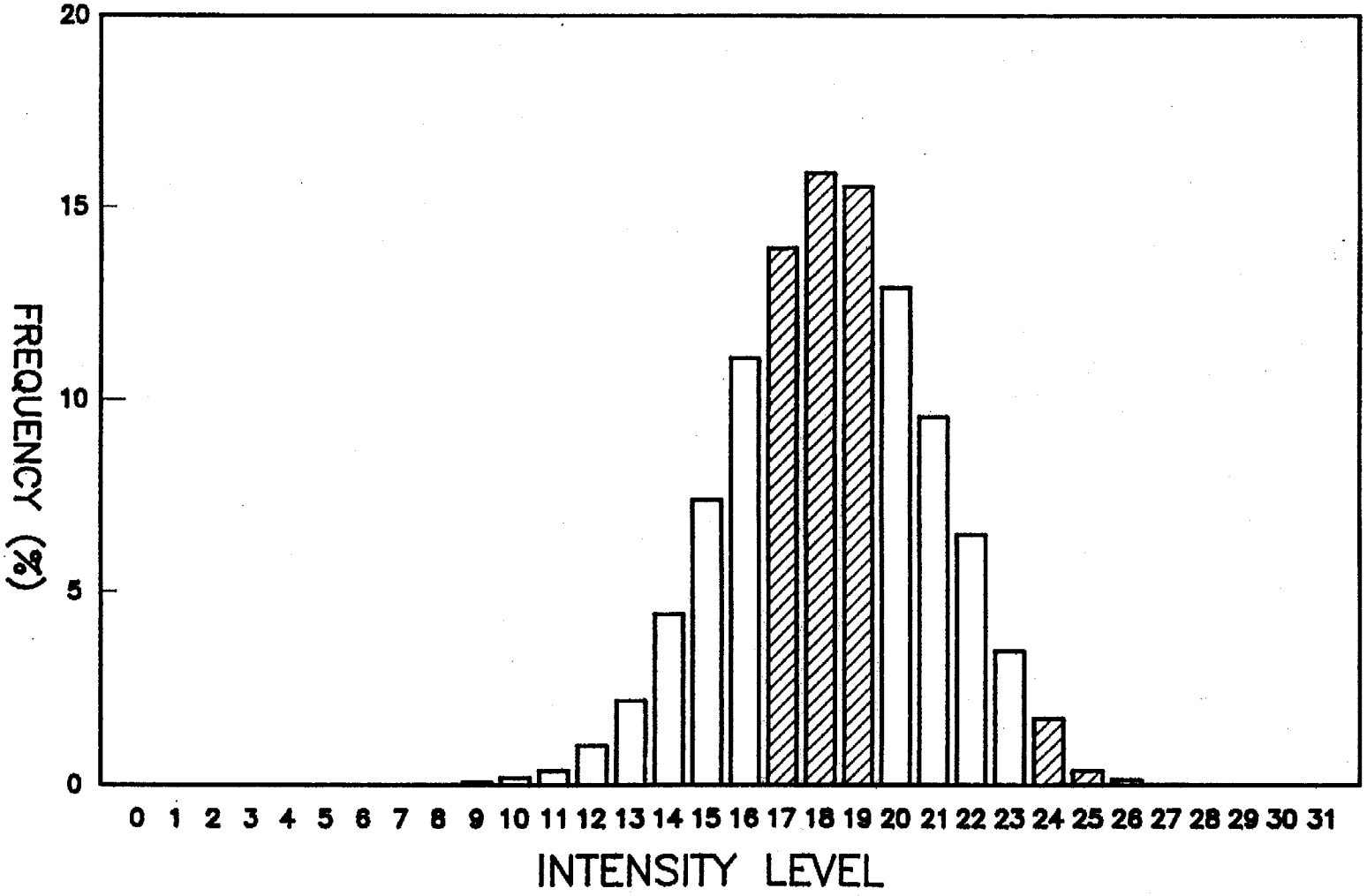
FIG. 2 is a graphic representation of an intensity distribution curve.

The intensity of the reflected light is recorded by the video camera 52 and transmitted to the image grabber board 51 which, in turn, generates an intensity distribution curve, an example of which is shown in FIG. 2. In FIG. 2 the intensity level is measured on a relative scale ranging from 0 to 31 with 0 representing black and 31 representing white. The intensity level is plotted against the frequency or likelihood that a particular pixel will have a certain intensity level. The "luster" of a sample is defined as the difference in intensity between the average intensity of the three highest intensity levels which occur and the average intensity of the middle three intensity levels which center on the most frequently occurring intensity levels. To further reduce electrical noise and variations associated with the digitization, the luster reading was calculated from an averaged image of four frames on the same location of a sample and seven readings taken for each sample at different locations.

The L value is a measure of the color of a given sample. Delta L is the difference between the L value of a particular sample and the L value of a reference. In the examples below the reference is a nylon 6 yarn that does not include any kaolin clay or titanium dioxide. L values can range from 0 to 100, with 0 representing black and 100 representing white. Consequently, the higher the L value the more white and chalkier the appearance. The L values are Hunter $L_H$ values measured according to ASTM D 2244-89.

EXAMPLE 1

Nylon 6 polymer chip was oven dried under nitrogen gas to a moisture content of <0.3 wt. % moisture. The dry chips (81.0 pounds) were tumble blended with 0.80 pounds of mineral oil in a twin shell rotary blender. After the chips were well coated with the oil, 9.0 pounds of calcined kaolin clay (available from Dry Branch Kaolin Co. under the tradename Glomax JDF) was added to the nylon chips and blended for 1 hour. The day coated chips were then extruded in a twin screw extruder with an exit polymer temperature of about 260° C. The strand of nylon with approximately 10 wt. % clay was cooled by quenching in an ice water bath. The cold strand was chopped into small chips with a mill. The nylon chips were dried in a vacuum oven to about 0.3 wt. % moisture and subsequently packed out and sealed closed. This concentrate was analyzed for ash and found to contain 9.28 wt. % ash (wt.% ash=wt. % clay). Concentrates were made using the same method with other calcined kaolin clays available from Englehard Inc. under the tradename Satintone Special and Burgess under the tradename Optiwhite. The concentrates were melt blended with base nylon 6 that contained no fillers or titanium dioxide to obtain blends having a target amount of 1–2 wt. % clay. For comparative purposes, concentrates were made that contained anatase $TiO_2$ available from Kemira, Inc. under the trade name Unitane 0-310, blended with base nylon 6 that did not contain any kaolin clay, and then spun into yarn as described above. The amount of titanium dioxide in comparative samples 6 and 7 is equal to the amount of ash.

The resulting blends were spun as 2900 undrawn denier, 50 filament bulked continuous filament yarns, with a trilobal ("Y") filament cross section having a modification ratio of about 3.0 to 3.1. A commercial spin finish was applied at 6% wet pickup to the undrawn yarns. The undrawn yarns were drawn to a final denier of about 1100. The yarns were analyzed for % ash (% clay) with the results shown below in Table 1.

The yarns were Superba heat set and 2 plied with 4.25S×4.25Z twist then tufted into carpets. The carpets were tufted on a 1/10 gauge machine with a cut pile height of 9/32 inches and 28 oz./sq. yd. weight. Prior to tufting, yarn samples were wrapped around black cardboard as described above in order to measure their luster. The modification ratio and luster results for the samples are given below in Table 1.

TABLE 1

| Sample No. | Additive | wt % Ash | Mod Ratio | Luster |
|---|---|---|---|---|
| Comp. 1 | None | 0.018 | 3.089 | 8.96 |
| 2 | Optiwhite | 0.998 | 3.007 | 3.54 |
| 3 | Optiwhite | 1.982 | 3.006 | 1.96 |
| 4 | Satintone | 1.015 | 3.079 | 3.56 |
| 5 | Satintone | 1.984 | 3.069 | 1.36 |
| Comp. 6 | $TiO_2$ only | 0.174 | 3.034 | 3.79 |
| Comp. 7 | $TiO_2$ only | 0.285 | 3.035 | 2.13 |

It is clear from Table 1 that kaolin clay reduces the luster of nylon 6 yarn to at least the same extent as the conventional amount of $TiO_2$.

EXAMPLE 2

Concentrates were made as in Example 1 where dried nylon chips were first coated with 0.1% mineral oil and then tumble blended with the appropriate calcined kaolin clay. Two additional types of calcined kaolin clay were used that had been surface treated—tradename Translink 445, Translink 555 (treated with an aminosilane) and tradename Ultralink PA-100, both available from Englehard. The Satintone Special and Optiwhite clays are not surface treated. The coated chips were extruded on the twin screw extruder, quenched and pelletized with the mill. The concentrate chips were then dried to <0.3 wt. % moisture in a steam heated vacuum oven.

These concentrates were blended with nylon 6 to give blends with 0.5, 1.0, or 2.0 wt. % day. These chip blends were dried and spun on a one inch laboratory-scale extruder to give nominal 1125 denier 70 filament yarn. The yarns had a trilobal ("Y") cross section with a nominal 3.0 modification ratio. The luster of the drawn yarn samples are shown below in Table 2. Unlike the luster results shown in Table 1, the luster results shown in Table 2 were obtained by visually ranking the samples wherein nylon 6 with no additive is assigned a ranking of 1 (brightest) and nylon 6 with 0.25 wt. % $TiO_2$ is assigned a ranking of 6 (dullest). Comparative yarn samples 14 and 15 include the anatase $TiO_2$ only in the wt. % ash amounts shown. The yarns were wrapped on a piece of black cardboard. The wrapped samples were placed on a table and visually compared by three people.

TABLE 2

| Sample No. | Additive | wt % Ash | Luster Rank |
|---|---|---|---|
| Comp. 1 | None, Control | 0.04 | 1 |
| 2 | Ultralink PA | 0.59 | 2 |
| 3 | Ultralink PA | 0.91 | 3 |
| 4 | Ultralink PA | 1.71 | 6 |
| 5 | Translink 555 | 0.63 | 2 |
| 6 | Translink 555 | 0.94 | 2 |
| 7 | Translink 555 | 1.79 | 3 |
| 8 | Translink 445 | 0.68 | 1 |
| 9 | Translink 445 | 0.98 | 3 |
| 10 | Translink 445 | 1.87 | 5 |
| 11 | Satintone Sp. | 0.65 | 2 |
| 12 | Satintone Sp. | 1.00 | 3 |
| 13 | Satintone Sp. | 1.93 | 6 |
| Comp. 14 | $TiO_2$ only | 0.16 | 3 |
| Comp. 15 | $TiO_2$ only | 0.23 | 6 |

A comparison between non-surface treated calcined kaolin clay and several surface treated calcined kaolin clays indicated no advantage to the use of the surface treatment over untreated clays.

EXAMPLE 3

A concentrate was prepared with nylon 6 and calcined kaolin clay (Glomax JDF). The concentrate produced was a small, light colored chip with 30.5 wt. % ash.

This 30.5 wt. % concentrate was blended with base nylon 6 to give a series of blends with a range of clay loadings. The chip blends were spun into trilobal fibers as previously described in Examples 1 and 2. The yarns were drawn and steam jet textured to give a yarn of nominal 1125 denier 70 filament with a trilobal cross section and about a 3.0 modification ratio. Comparative yarn samples 8–11 include titanium dioxide in the amounts shown (=wt. % ash), but no clay. The luster and color results are provided below in Table 3.

TABLE 3

| Sample No. | wt % Ash | Luster | L Value | Delta L |
|---|---|---|---|---|
| Comp. 1 | 0 | 4.92 | 69.56 | 0 |
| 2 | 0.51 | 2.24 | 68.823 | 0.737 |
| 3 | 0.69 | 1.22 | 66.787 | 2.773 |
| 4 | 0.82 | 1.11 | 66.343 | 3.217 |
| 5 | 1.34 | 0.5 | 67.103 | 2.457 |
| 6 | 1.85 | 0.4 | 67.71 | 1.85 |
| Comp. 7 | 3.40 | 0.37 | 68.227 | 1.333 |
| Comp. 8 ($TiO_2$ only) | 0.115 | 3.2 | 68.226 | 0.977 |
| Comp. 9 ($TiO_2$ only) | 0.142 | 2.02 | 69.167 | 0.036 |
| Comp. 10 ($TiO_2$ only) | 0.233 | 1.48 | 68.687 | 0.516 |
| Comp. 11 ($TiO_2$ only) | 0.269 | 1.7 | 68.182 | 1.021 |

These results show that above 2.0 wt. % clay the luster curve was flat. In other words, an increase in the amount of clay above 2.0 wt. % did not give any further substantial decrease in the luster. In addition, these results show that the clay reduces the L value to a much greater extent than the conventional amount of $TiO_2$ thus decreasing the chalky appearance of the yarn to a much greater extent.

I claim:

1. A delustered polyamide fiber comprising as a delustrant 0.3 to 2.0 weight percent calcined kaolin clay having an average particle size of 0.1 to 2.0 microns and less than 0.1 weight percent titanium dioxide, said weight percents being based on the weight of the fiber, said delustered fiber being characterized by an absence of chalkiness.

2. The polyamide fiber according to claim 1, wherein the polyamide is selected from the group consisting of nylon 6 and nylon 66.

3. The polyamide fiber according to claim 1, comprising 0.6 to 1.0 weight percent calcined kaolin clay.

4. The polyamide fiber according to claim 1, wherein said polyamide fiber includes effectively 0 weight percent titanium dioxide.

5. The polyamide fiber according to claim 1, wherein said calcined kaolin clay has an average particle size of 0.1 to 0.5 microns.

* * * * *